United States Patent [19]

O'Garr

[11] Patent Number: 5,007,345

[45] Date of Patent: Apr. 16, 1991

[54] METHOD AND APPARATUS FOR CHARGING WATERLOGGED BOREHOLES WITH EXPLOSIVES

[76] Inventor: Phil O'Garr, R.R. #3, Frankford, Ontario, Canada, K0K 2C0

[21] Appl. No.: 400,695

[22] Filed: Aug. 30, 1989

[51] Int. Cl.[5] ..... F42B 3/00

[52] U.S. Cl. ..... 102/313; 102/312; 86/20.15; 166/63; 299/13

[58] Field of Search ..... 102/311, 312, 313; 86/20.15; 299/13; 166/63

[56] References Cited

U.S. PATENT DOCUMENTS

| | | | |
|---|---|---|---|
| 3,921,497 | 11/1975 | Christmann et al. | 86/20 C |
| 4,003,429 | 1/1977 | Hay et al. | 166/51 |
| 4,572,075 | 2/1986 | Day et al. | 102/313 |

*Primary Examiner*—Peter A. Nelson
*Assistant Examiner*—Chrisman D. Carroll
*Attorney, Agent, or Firm*—Fleit, Jacobson, Cohn, Price, Holman & Stern

[57] ABSTRACT

A method of charging waterlogged boreholes with water-resistant particulate explosive material, comprises inserting a pneumatic line with upwardly directed nozzles at the lower end thereof and a material supply line into a borehole, blowing compressed air through the pneumatic line such that at least a portion thereof is directed through the nozzles to form a substantially water-free air pocket around the lower end of the supply line, supplying particulate explosive material through the supply line to a charging zone in the vicinity of the lower end thereof, and gradually withdrawing said line as the borehole fills up with explosive material.

12 Claims, 4 Drawing Sheets

FIG. 1a
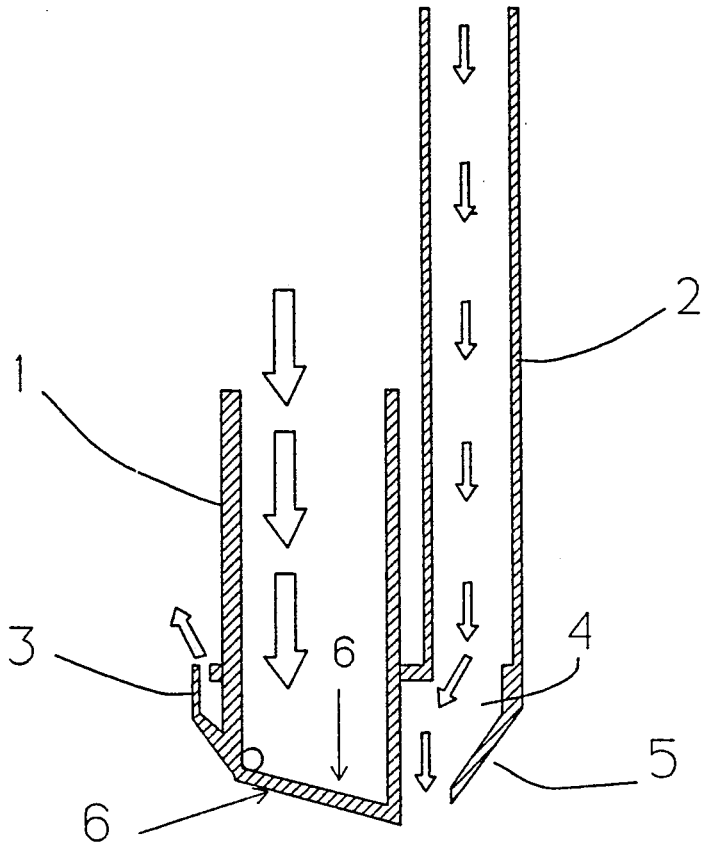
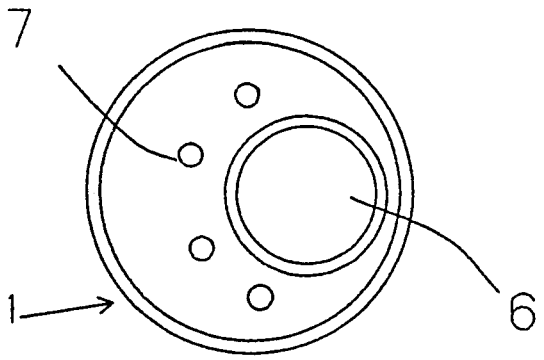
FIG. 1b
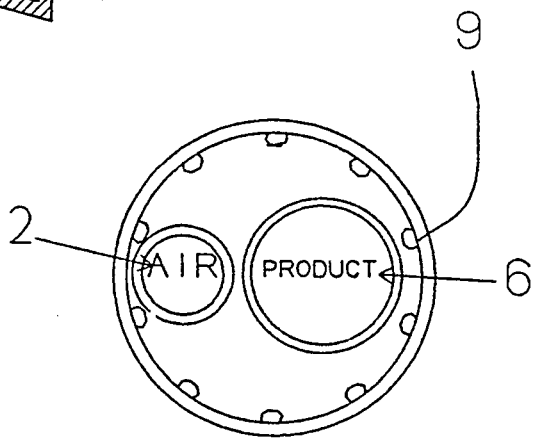
FIG. 1c

FIG. 2a
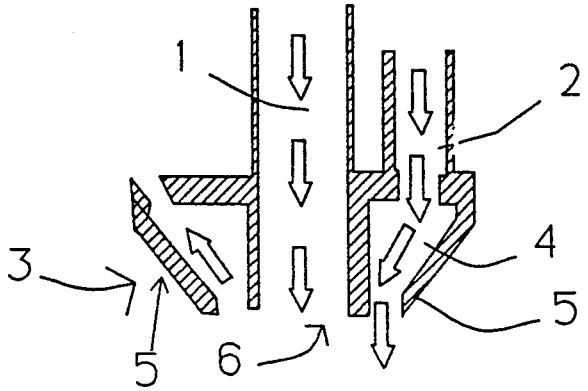
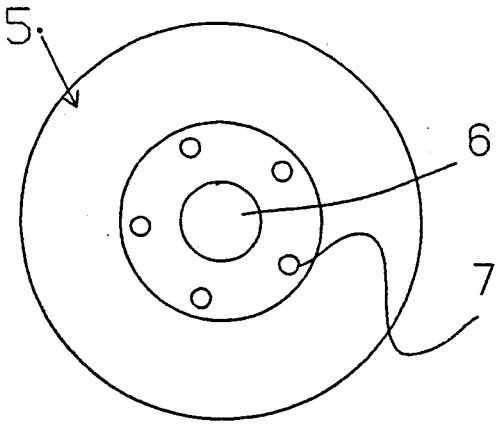
FIG. 2b
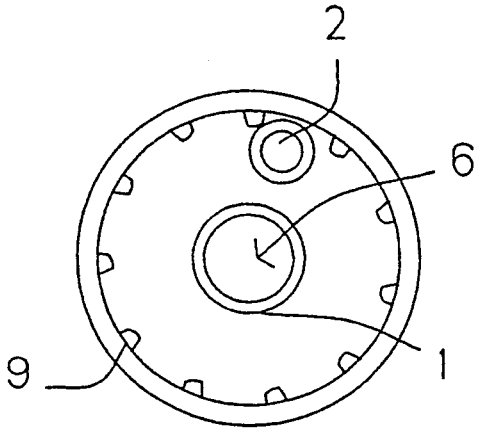
FIG. 2c

FIG. 3a
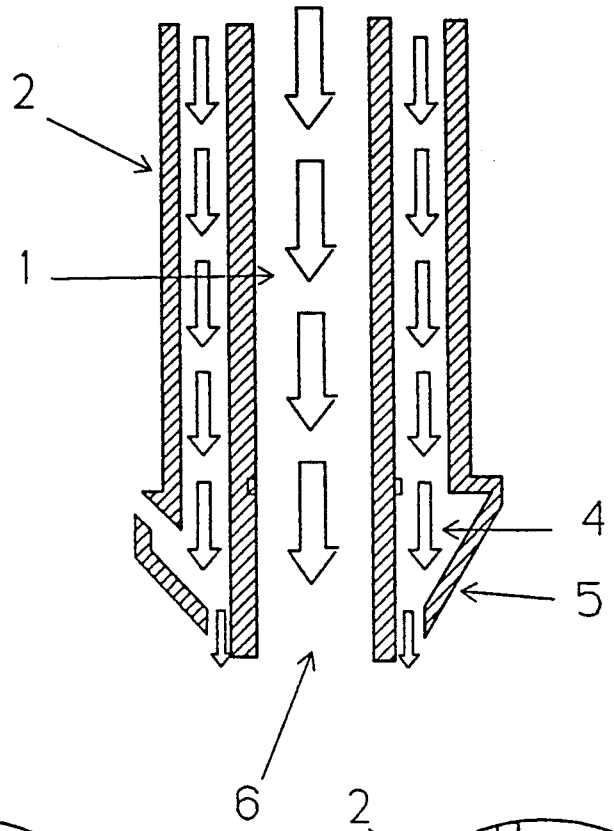
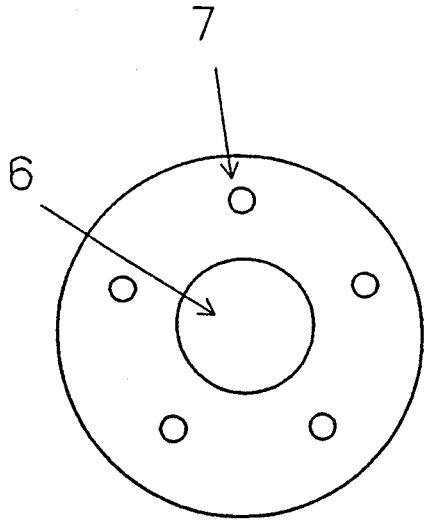
FIG. 3b
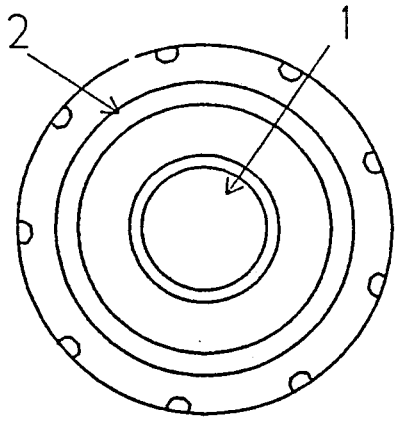
FIG. 3c

METHOD AND APPARATUS FOR CHARGING WATERLOGGED BOREHOLES WITH EXPLOSIVES

BACKGROUND OF THE INVENTION

This invention relates to a method and apparatus for charging waterlogged boreholes with water-resistant particulate explosive material.

The use of commercial explosives is wide-spread. They are used in mining operations and the construction industry, for example, for blasting out foundation holes and digging trenches for pipe laying.

A common blasting technique is to sink drill holes 2¼ to 15⅞ inches in diameter, depending on the application, in five hole arrays arranged with four of the holes forming the corners of a four foot square and the fifth hole in the centre of the array. The holes can be anything from 20 to 60 feet or more deep, again depending on the application.

Once the holes have been drilled they are packed with explosives. In this context there are three main types of explosives:

1. Cardboard packed dynamite type products, which cost about $250.00 per 100 kilograms
2. Plastic wrapped products, which cost in excess of $400.00 per 100 kilograms
3. Poured granular material, which costs anything from $60.00 to $160.00 per 100 kilograms.

The first two types are referred to as packaged explosives. The preferred technique is to use poured granular material. In this technique a detonator is placed at the bottom of the borehole, and the granular material is subsequently poured in until the borehole is full. The advantage is two-fold: Firstly the granular material is much cheaper than the other material. Secondly, imperfect contact between the wall of the hole and the explosive charge gives rise to an effect known as "decoupling". This effect, caused by the gap between the wall of the hole and the explosive charge, reduces the power of the explosion by interfering with the transmission of the shock wave into the surrounding rock strata.

Also, it is much easier to fill a hole with granular explosives because the material can be supplied from a storage tank mounted on a truck.

While it is desirable to use granular explosives, it has not been hitherto possible to use this material in water-bearing rock. While coated water-resistant granular explosive material is available, it cannot be packed into a waterlogged borehole because the water permeates between the particles of explosive and prevents detonation from occurring. In a waterlogged environment, it has therefore hitherto been necessary to employ packaged explosives of either the cardboard cartridge or plastic wrapped type. These cost from $250.00 to $400.00 per 100 kilogram, and furthermore are inconvenient to install because they have to be stacked one upon the other in the borehole.

An object of the invention is to alleviate the aforementioned problems of the prior art.

SUMMARY OF THE INVENTION

According to a first aspect of the invention there is provided a method of charging waterlogged boreholes with water-resistant particulate explosive material, comprising inserting a pneumatic line with upwardly directed nozzles at the lower end thereof and a material supply line into a borehole, blowing compressed air through said pneumatic line such that at least a portion thereof is directed through said nozzles to form a substantially water-free air pocket around the lower end of the supply line, supplying particulate explosive material through the supply line to a charging zone in the vicinity of the lower end thereof, and gradually withdrawing said line as the borehole fills up with explosive material.

This method permits the benefits of granular material to be enjoyed in a waterlogged environment. The pneumatic line creates a water-free air pocket in the charging zone, which allows the explosive material to be packed in a substantially water-free environment at densities of 0.7–0.9 or higher. It is important to have upwardly directed nozzles so as to create a curtain around the end of the pneumatic line where the explosive material is being supplied, since otherwise the water would merely be blown down into the hole and no advantage would be obtained.

In the above method the explosive is packed in substantially dry conditions so that water is not trapped between the explosive particles. Since the material itself is water-resistant, it does not matter that water may be subsequently present in the hole around the explosive material after the pneumatic line has been withdrawn. The important point is that the explosive material is not packed in the presence of substantial quantities of water, which would prevent proper detonation.

According to a further aspect of the invention there is provided an apparatus for charging waterlogged boreholes with water-resistant particulate explosive material, comprising a supply conduit for feeding the explosive material to the base of the borehole, a compressed air line for supplying compressed air to the bottom of the supply conduit, and a nozzle arrangement around the base of the supply conduit for directing compressed air upwardly around therearound to form a substantially water-free air pocket, whereby the explosive material can be supplied through said conduit to the base of the borehole in the vicinity of said air pocket.

The nozzle arrangement directs the air upwardly to form a "curtain" or air pocket around the base of the pneumatic line.

The nozzle arrangement should be made of copper or other nonferrous material to avoid the risk of generating sparks.

In a preferred embodiment, the nozzle arrangement is in the form of a closed dish with a central bore through which the explosive is supplied from the supply conduit. The undersurface of the dish is tapered and has a circular array of holes around the central bore for directing jets of air downwardly.

The upper surface of the dish forms a shoulder with a row of peripheral holes for directing air upwardly to form a curtain or air pocket around the lower end of the supply conduit. Preferably the holes in the upper surface are in the form of small channels set at an angle to the longitudinal axis of the supply conduit.

The air line can either surround concentrically the supply conduit or be set to one side thereof.

BRIEF DESCRIPTION OF THE DRAWINGS

The invention will now be described in more detail, by way of example only, with reference to the accompanying drawings, in which:

FIG. 1*a* is a longitudinal sectional view of a first embodiment of a nozzle arrangement in accordance with the invention;

FIG. 1*b* is an underneath view of the nozzle arrangement shown in FIG. 1*a;*

FIG. 1*c* is a top view of the nozzle arrangement shown in FIG. 1*a;*

FIG. 2*a* is a sectional view of a second embodiment of a nozzle arrangement in accordance with the invention;

FIG. 2*b* is an underneath view of the nozzle arrangement shown in FIG. 2*a;*

FIG. 2*c* is a plan view of the nozzle arrangement shown in FIG. 2*a;*

FIG. 3*a* is a sectional view of a third embodiment of a nozzle arrangement according to the invention;

FIG. 3*b* is an underneath view of the nozzle arrangement shown in FIG. 3*a;*

FIG. 3*c* is a plan view of the nozzle arrangement shown in FIG. 3*a;* and

DESCRIPTION OF THE PREFERRED EMBODIMENTS

Figure 4:
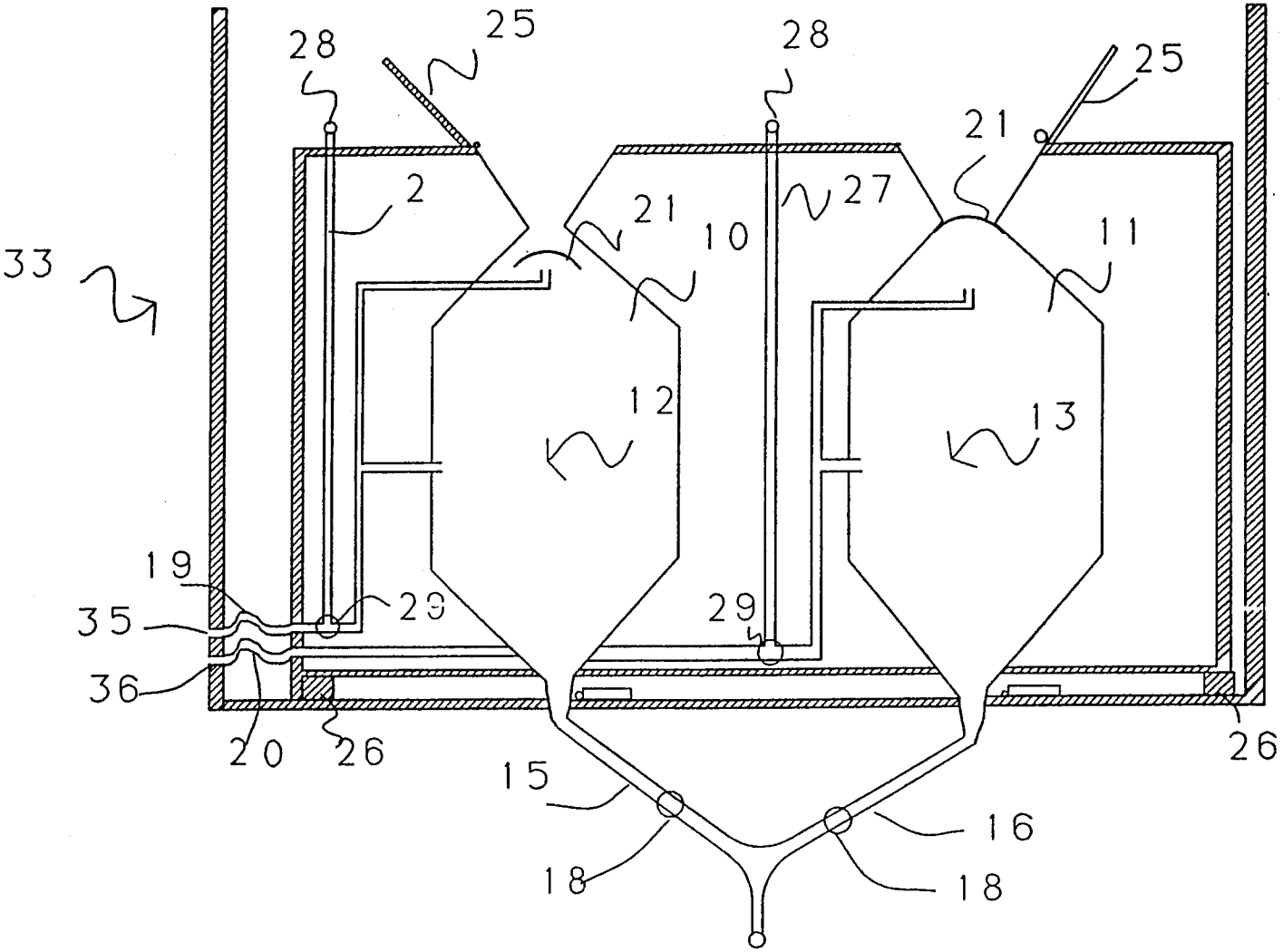
FIG. 4 is a diagrammatic view of a loading truck for an apparatus in accordance with the invention.

The nozzle arrangement shown in FIGS. 1*a* to 1*c* is made entirely of copper to eliminate the risk of spark generation. The nozzle arrangement comprises a main supply pipe 1 of 1 inch diameter and a parallel half inch diameter pipe 2 for compressed air. The pipes 1 and 2 can be connected to flexible hoses (not shown).

The pipes 1, 2 terminate in a dish-shaped nozzle arrangement 3 forming a plenum chamber 4 in communication with the compressed air pipe 2. The under surface of the nozzle arrangement 3 has inclined surfaces 5 tapering to an outlet 6 of the supply pipe 1, which is closed by a hinged flap 6'. An arcuate array of 7/16 inch holes 7 partially surround the outlet 6 of the supply pipe 1.

The upper surface 8 of the nozzle arrangement 3 comprises a diffuser plate, which has evenly arranged around its periphery a plurality of holes 9 in communication with the plenum chamber 4. The holes 9 form channels in the upper plate 8 and are directed outwardly at an incline so as to direct compressed air upwardly towards the wall of the bore hole (not shown).

In operation the nozzle arrangement is lowered to the base of the waterlogged borehole and compressed air supplied through the supply pipe 2 into the plenum chamber 4. From there the compressed air is forced through the hole 7 to form jets under the outlet 6 of the supply pipe and also upwardly through the holes 9 to form a curtain around the lower end of the assembly. The water in the hole is blown upwards and an air pocket created around the outlet 6 of the supply pipe. Water-resistant granular explosive material can then be supplied through the supply pipe 1 in the same manner as for a dry hole and packing densities of 0.7 to 0.9 or higher achieved. This compares favourably to the packing density for the much more expensive packaged products of 1 to 1.3.

As the explosive material is poured, the assembly can be withdrawn taking the air pocket with it up the bore hole. The packing density can be maintained throughout the waterlogged region. Once the water table is cleared, the supply of compressed air no longer becomes necessary and the remaining portion of the bore hole can be packed in the conventional manner.

Of course, prior to pouring the explosive material, a detonator is placed at the base of the hole in the same manner as for dry conditions. The detonator can be a conventional detonator used for dry conditions consisting of TNT, PETN, and black powder with an electric or percussion detonation system.

By way of cost comparison, 30 kilograms of granular material packed in this manner in a ten meter hole would cost about $42.00 as compared with $105.00 for packaged material, which was hitherto necessary.

The second embodiment shown in FIGS. 2*a* to 2*c* is similar to the embodiment shown in FIGS. 1*a* to 1*c* and like parts are identified with like reference numerals. The main difference is that the supply pipe 1 is arranged centrally with respect of the nozzle arrangement and completely surrounded on its underside by holes 7, whereas in the embodiment shown in FIGS. 1*a* to 1*c* the nozzle arrangement is offset to one side. In both embodiments the compressed air pipe 2 is located to one side of the supply pipe 1.

The embodiment shown in FIGS. 3*a* to 3*c* is similar to the embodiment shown in FIGS. 2*a* to 2*c* with the difference that the compressed air pipe $2^1$ is arranged concentrically around the main supply pipe 1. As in the embodiment of FIGS. 2*a* to 2*c*, the holes 7 surround the outlet 6 of the supply pipe 1 on the underside.

The illustration on FIG. 4 shows a loading container for installation on an explosives truck, especially adapted for use with the present invention. The entire arrangement is made of non-ferrous metal to comply with the regulations for transporting explosive materials.

It comprises two containers 10, 11 containing respectively non-water resistant granular explosive material 12, costing about $60.00 per 100 kilograms, and water-resistant explosive material, costing about $160.00 per 100 kilograms. The water resistant material is made of the same nitrate based explosive as the material 12 with the difference that the granules are especially coated to inhibit the permeation of water. More particularly, the explosive material 12 is Nilite TM and the material 13 Tovan WR TM.

The two containers are surrounded by a wooden box 14 for safety purposes.

The containers are connected through outlets pipes 15, 16 to a common outlet 17. Each pipe 15, 16 has a respective control valve 18.

Lines 19, 20 supply compressed air to the respective containers 10, 11. This compressed air is used for a purpose different from that previously described in connection with the nozzle arrangement.

The box 14 is a schedule H container with trap doors 25. The box 14 is mounted on skid and locking lags 26. The supply lines 19 and 20 have valve shafts 27 emerging from the top of the container, each terminating in a non-sparking valve handle 28. The air valves 4 controlling the flow to the containers 10, 11 are referenced 29. The containers 10,11 terminate in 30 that penetrate apertures 31 in floor 31 of trap body 33. The apertures 31 can be closed by trap doors 34 when the tanks are not present. The air lines 19, 20, have quick connectors 35, 36.

When the boreholes are ready for packing with explosives, the operator drives the truck up to the boreholes and feeds into the borehole the supply line with the nozzle assembly at the end. Depending on whether the conditions are wet or dry, the operator then adjusts the settings of valves 18 to feed the cheaper non-water resistant material 12 or the more expensive water-resistant material 13 into the bore hole. This is done with the aid of the pneumatic lines 19,20 which blow the material out of the containers by generating a positive pressure therein. The upper end of the containers can be closed by a moveable plate 21, providing an automatic sealing dome, that is urged upwardly by air pressure, but which can be withdrawn when the hopper is not under pressure for ventilation purposes.

If it is determined that the hole is waterlogged, and thus the water-resistant material 13 selected, the operator also activates a valve (not shown) to blow compressed air through the compressed air pipe 2, $2^1$ so as to form a pocket around the lower end of the supply conduit. The water-resistant granular material is then charged into the borehole and the desired packing density achieved.

The present invention represents a substantial advance in the art. Instead of having to pack a borehole with a large number of packages of explosives, the granular material can be conveniently poured in from the supply truck. Waterlogged conditions can be coped with merely by changing over the valves 18 to direct the water-resistant material into the borehole and opening the valve to supply compressed air to the compressed air pipe. Such an arrangement provides a very efficient technique of charging boreholes under all common operating conditions and can be readily adapted for many environments such as construction sites, underground mines, open cast mines and the like.

I claim:

1. A method of charging waterlogged boreholes with water resistant particulate explosive material, comprising inserting a pneumatic line with upwardly directed nozzles at the lower end thereof and a material supply line into a borehole, blowing compressed air through said pneumatic line such that at least a portion thereof is directed through said nozzles to form a substantially water-free air pocket around the lower end of the supply line, supplying particulate explosive material through the supply line to a charging zone in the vicinity of the lower end thereof, and gradually withdrawing said line as the borehole fills up with explosive material.

2. A method of charging waterlogged boreholes as claimed in claim 1, wherein said compressed air is also directed downwardly to create an air pocket below the lower end of the supply line where the particulate material is being discharged.

3. A method of charging waterlogged boreholes as claimed in claim 1, wherein said compressed air flows down concentrically around the supply line.

4. A method of charging waterlogged boreholes as claimed in claim 1, wherein said compressed air flows down to one side of the supply line.

5. A method of charging waterlogged boreholes as claimed in claim 1, wherein the explosive material is fed to said supply line pneumatically.

6. A method of charging waterlogged boreholes as claimed in claim 1, wherein the explosive material is supplied from a pressurized tank mounted on a supply truck.

7. An apparatus for charging waterlogged boreholes with water-resistant particulate explosive material, comprising a supply conduit for feeding the explosive material to the base of the borehole, a compressed air line for supplying compressed air to the bottom of the supply conduit, and a nozzle arrangement around the base of the supply conduit for directing compressed air upwardly around therearound to form a substantially water-free air pocket, whereby the explosive material can be supplied through said conduit to the base of the borehole in the vicinity of said air pocket.

8. An apparatus for charging waterlogged boreholes as claimed in claim 7, wherein said nozzle arrangement comprises an enclosed housing defining a pneumatic chamber having an inlet communicating with said pneumatic line and a row of upwardly facing peripheral apertures arranged to form upwardly directed air jets around the lower end of the supply line.

9. An apparatus for charging waterlogged boreholes as claimed in claim 8, wherein said housing comprises a closed dish having a tapered lower end face, and a main conduit extending therethrough and communicating with said supply line, whereby explosive material is discharged into the borehole from the tapered lower face of said housing.

10. An apparatus for charging waterlogged boreholes as claimed in claim 9, wherein lower end face of the dish also has apertures around the main conduit to form downwardly directed air jets for flushing water from said charging zone.

11. An apparatus for charging waterlogged boreholes as claimed in any of claims 7 to 9, wherein the supply line and pneumatic line are arranged in a concentric arrangement.

12. An apparatus for charging waterlogged boreholes as claimed in-any of claims 7 to 9, wherein the supply line and pneumatic line are arranged in a side by side arrangement.

* * * * *